United States Patent [19]

Sverdlik et al.

[11] 4,421,318

[45] Dec. 20, 1983

[54] ADJUSTABLE REBOUND APPARATUS

[76] Inventors: David Sverdlik, 6428 N. Mozart; Arnold I. Vodovozov, 2858 W. Touhy Ave., Unit A, both of Chicago, Ill. 60645

[21] Appl. No.: 364,260

[22] Filed: Apr. 1, 1982

[51] Int. Cl.[3] ..... A63B 69/00; A63B 71/02

[52] U.S. Cl. ..... 273/395; 273/411

[58] Field of Search ..... 273/395, 407, 1.5 R, 273/1.5 A, 30, 26 A, 181 K, 29, 411

[56] References Cited

U.S. PATENT DOCUMENTS

| | | | |
|---|---|---|---|
| 743,048 | 11/1903 | Suffern | 248/455 |
| 1,568,013 | 12/1925 | Warfield | 273/395 |
| 2,194,786 | 3/1940 | Chervenka et al. | 273/1.5 R |
| 2,482,234 | 9/1949 | Barker | 273/395 |
| 2,806,669 | 9/1957 | Vernon | 248/455 |
| 3,001,790 | 9/1961 | Pratt | 273/26 A |
| 3,016,242 | 1/1962 | Colucci | 273/395 |
| 3,511,503 | 5/1970 | Volpe | 273/395 |
| 3,743,286 | 7/1973 | Weinhagen et al. | 273/407 X |
| 3,752,476 | 8/1973 | Mahoney | 273/1.5 A |
| 3,836,144 | 9/1974 | Mahoney | 273/395 X |
| 4,026,551 | 5/1977 | Larson | 273/30 X |
| 4,093,218 | 6/1978 | Burchers | 273/29 |
| 4,145,044 | 3/1979 | Wilson et al. | 273/1.5 R |
| 4,239,235 | 12/1980 | Torres | 273/395 |

FOREIGN PATENT DOCUMENTS

| | | | |
|---|---|---|---|
| 234082 | 3/1960 | Australia | 273/395 |
| 1069207 | 5/1967 | United Kingdom | 273/407 |

OTHER PUBLICATIONS

Sports Illustrated, 12-1-1969, vol. 31, No. 23.

*Primary Examiner*—Paul E. Shapiro

*Attorney, Agent, or Firm*—Dithmar, Stotland, Stratman & Levy

[57] ABSTRACT

A ball rebound apparatus includes a part-cylindrical rebound panel with attachment flanges at the lateral extremities thereof and with parallel end walls closing the axial extremities thereof. The panel is mountable on and between two adjustable, triangular support frames, each having a base rail connectable to the ground or other underlying support surface, a mounting rail to which the rebound panel is attached and a support rail connectable to the base rail at various locations for changing the inclination of the mounting rail. The rebound panel is reversible so that it can be mounted with either its concave surface or its convex surface disposed forwardly. It is also mountable with its cylindrical axis disposed in a vertical plane, with the attachment flanges secured to the support frame, or with its cylindrical axis disposed in a horizontal plane, with its end walls secured to the support frame.

12 Claims, 10 Drawing Figures

ADJUSTABLE REBOUND APPARATUS

BACKGROUND OF THE INVENTION

This invention relates generally to rebound apparatus of the type used in ball games and the like for providing a target at which a ball can be thrown for rebounding the ball to the thrower or other player.

Rebound devices for rebounding a ball or the like are known in the art, but they commonly have a flat planar rebound surface. Since the lateral extent of the rebound surface is limited, the angular range into which the ball can be rebounded is also limited. In order for a player to effect a large rebound angle he must position himself so as to obtain an equally large angle of incidence of the ball against the rebound surface. This severely limits the strategy of play, since a very narrow range of rebound angles is possible from any one throwing position.

Rebound devices with either curved or sectioned rebound surfaces are known, but they always present the same surface to the players, and while inclinable rebound surfaces have been used, the basic orientation of the rebound surface is fixed.

SUMMARY OF THE INVENTION

It is a general object of this invention to provide an improved rebound apparatus which avoids drawbacks of prior devices while affording additional structural and operating advantages.

It is an important object of this invention to provide a rebound apparatus which presents a curved rebound surface which is adjustably inclinable.

Another object of this invention is the provision of a rebound apparatus of the type set forth which has both convex and concave rebound surfaces which are selectively presentable to the player.

Yet another object of this invention is the provision of a rebound apparatus of the type set forth wherein the rebound surface is part-cylindrical and is selectively mountable so that the cylindrical axis is disposed in either a vertical plane or a horizontal plane.

It is another object of this invention to provide rebound apparatus of the type set forth which includes support means cooperable with a rebound member to effect a variety of mounted orientations for the rebound member.

These and other objects of the invention are attained by providing a ball rebound apparatus comprising a rebound member having a curved rebound surface, support means coupled to the rebound member for supporting same, and adjustment means on the support means for varying the inclination of the rebound surface.

The invention consists of these and other novel features and a combination of parts hereinafter fully described, illustrated in the accompanying drawings, and particularly pointed out in the appended claims, it being understood that various changes in the details may be made without departing from the spirit, or sacrificing any of the advantages of the invention.

DESCRIPTION OF THE PREFERRED EMBODIMENTS

Figure 2:
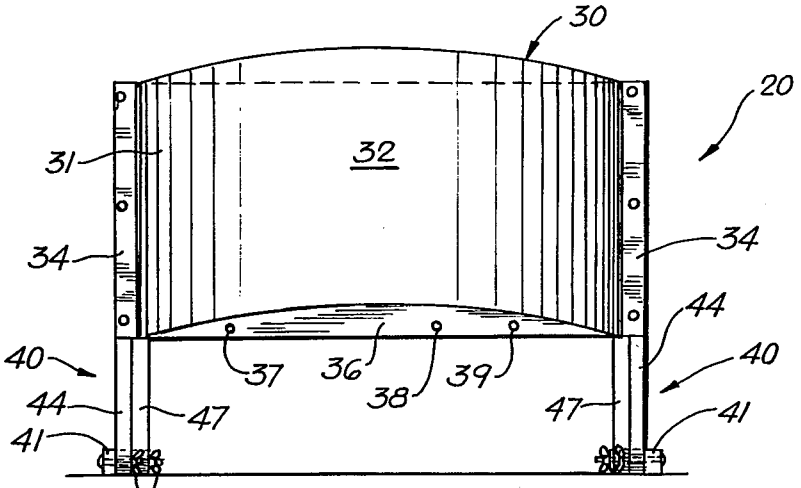
FIG. 2 is a front elevational view of the rebound apparatus of FIG. 1.
Figure 3:
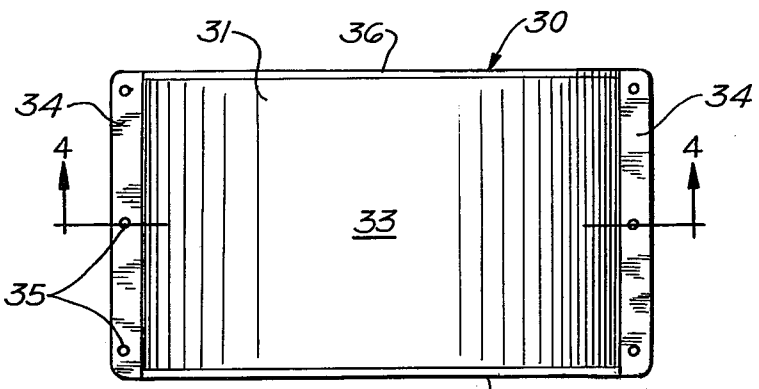
FIG. 3 is a bottom plan view of the rebound board of the apparatus of FIGS. 1 and 2.
Figure 4:
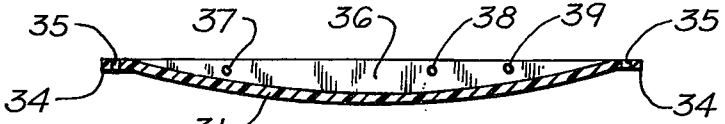
FIG. 4 is a view in vertical section taken along the line 4—4 in FIG. 3.

There is illustrated in FIGS. 1 through 9 of the drawings a rebound apparatus, generally designated by the numeral 20, which includes a rebound board 30 mounted on a pair of support frames 40. Referring in particular to FIGS. 1 through 4 of the drawings, the rebound board 30 includes a part-clyindrical panel 31 which is preferably circularly cylindrical in shape, and has a convex surface 32 and a concave surface 33. Respectively integral with the opposite sides of the panel 31 and extending the axial length thereof and projecting laterally outwardly therefrom are two side attachment flanges 34, each providing with three spaced-apart holes 35 therethrough. Closing the axial ends of the panel 30 are two parallel part-circular end walls 36, each provided with holes 37, 38 and 39 therethrough, the hole 37 being disposed adjacent to one side edge of the board 30 and the holes 38, 39 being disposed adjacent to the other side edge of the board 30.

The support frames 40 are substantially mirror images of each other and, therefore, only one will be described in detail. Each support frame 40 includes an elongated base rail 41 having a plurality of longitudinally spaced-apart holes 42 extending laterally therethrough, and having a bore 43 extending transversely therethrough adjacent to one end thereof normal to the holes 42. The frame 40 also includes an elongated mounting rail 44 having a plurality of spaced-apart holes 45 extending laterally therethrough and three spaced-apart bores 46 extending transversely therethrough normal to the direction of the holes 45. The frame 40 also includes an elongated support rail 47 provided adjacent to the opposite ends thereof with holes 48 extending laterally therethrough. The frame 40 also includes a spacer block 49.

In assembly of each of the frames 40, one end of the mounting rail 44 is connected to the forward end of the base rail 41 by a bolt 50 passed through complementary holes in the rails and a wing nut 51. The support rail 47 has one end thereof connected to the mounting rail 44 by a bolt 50 passed through the upper one of the holes 45 in the rail 44 and through the complementary hole 48 in the rail 47. The lower end of the support rail 47 is connected to the base rail 41 by a bolt 50 passed through a selected one of the holes 42 and the other hole 48 in the rail 47. Preferably, the mounting rail 44 is disposed inside the base rail 41 and the support rail 47 is disposed inside the mounting rail 44. Accordingly, the spacer block 49 which has a thickness equal to that of the mounting rail 44, is disposed between the support rail 47 and the base rail 41 to maintain the support rail 47 parallel to the other rails (see FIG. 7).

Figure 1:
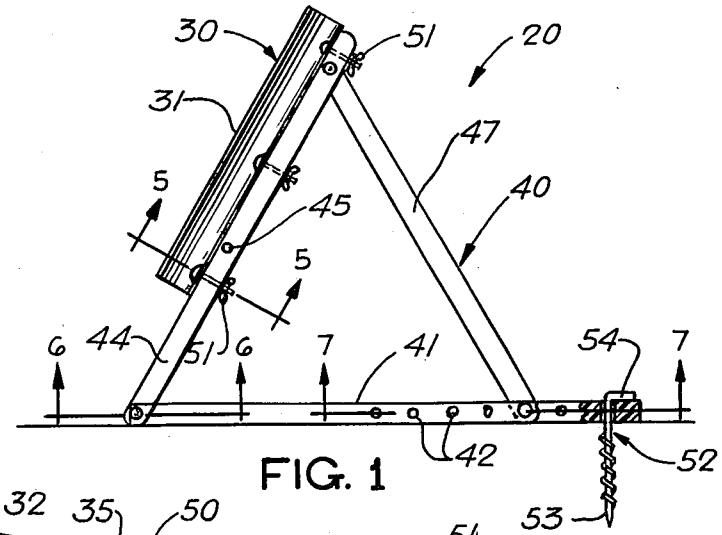
FIG. 1 is a side elevational view of a rebound apparatus constructed in accordance with and embodying the features of the present invention, with the rebound member disposed with its convex surface forward and its axis disposed in a vertical plane.
Figure 6:
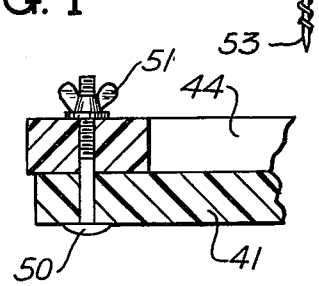
FIG. 6 is an enlarged, fragmentary sectional view taken along line 6—6 in FIG. 1.
Figure 5:
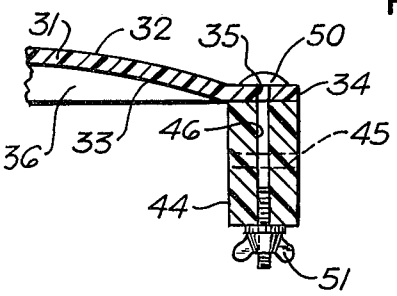
FIG. 5 is an enlarged, fragmentary sectional view taken along the line 5—5 in FIG. 1.
Figure 7:
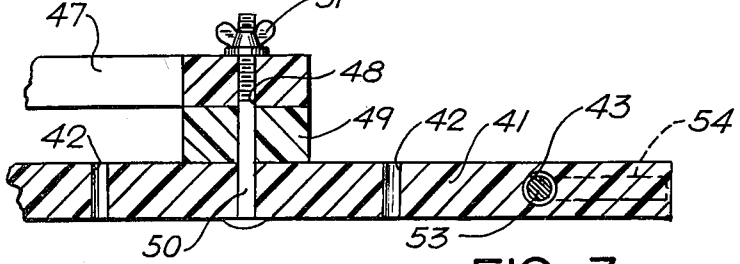
FIG. 7 is an enlarged, fragmentary sectional view taken along the line 7—7 in FIG. 1.

In mounting the rebound board 30 on the frames 40, the frames 40 are spaced apart a distance substantially equal to the width of the rebound board 30. Referring to FIGS. 1 and 2 of the drawings, in mounting the rebound board 30 with its cylindrical axis disposed in a vertical plane, the side flanges 34 are repectively placed over the forward edges of the mounting rails 44 and secured thereto by bolts 50 passed through the holes 35 and the bores 46 (see FIGS. 1 and 5) and secured by wing nuts 51. When thus assembled, the rebound apparatus 20 is free-standing. However, if desired, the base rails 41 can be anchored to the ground or underlying support surface by the use of anchor stakes 52. More specifically, each anchor stake 52 has an elongated shaft 53 which is passed through the bore 43 in the associated base rail 41 and into the ground, the stake 52 having a short handle 54 extending perpendicular to the shaft 53 for facilitating insertion and to limit the depth of insertion. If desired, the shaft 53 may be threaded as with an auger thread so that it can be screwed into the ground or support surface.

A significant aspect of the present invention is that the rebound board 30 can be easily reversed so that, instead of having its convex surface 32 disposed forwardly, as in FIGS. 1 and 2, it can be positioned with its concave surface 33 disposed forwardly, the manner of attachment to the frames 40 being the same in either case. This affords a great deal of flexibility in the type of rebound action imparted to the ball.

It is also an aspect of this invention that the inclination of the rebound board 30 is adjustable by moving the lower ends of the support rails 47 forwardly or rearwardly along the base rails 41, several discrete adjustment positions being provided corresponding, respectively, to the positions of the holes 42.

Figure 8:
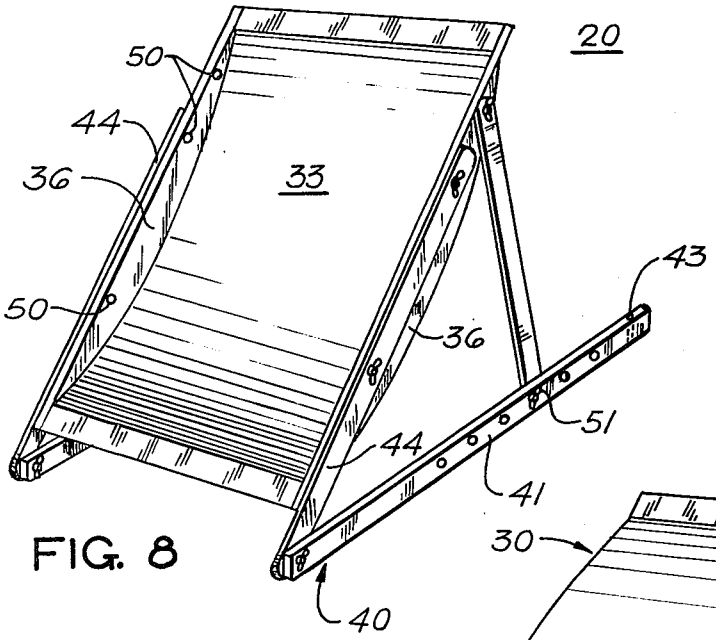
FIG. 8 is a front perspective view of the rebound apparatus of FIG. 1, with the rebound board thereof disposed with its concave surface toward and with its cylindrical axis disposed in a horizontal plane.
Figure 9:
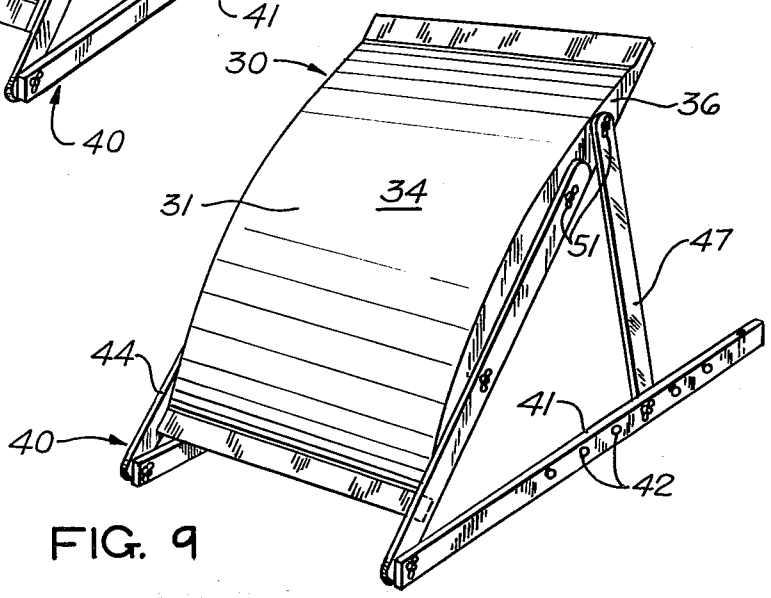
FIG. 9 is a view similar to FIG. 8, showing the rebound board reversed with its convex surface forward.

It is another significant aspect of this invention that the rebound board 30 can be mounted in a second orientation with its cylindrical axis disposed in a horizontal plane, as illustrated in FIGS. 8 and 9 of the drawings. For mounting the rebound board 30 in this configuration, the mounting rails 44 are respectively positioned along the outer surfaces of the end walls 36 of the rebound board 30 and the uppermost two of the holes 45 are respectively aligned with the holes 37 and 38 in the end walls 36 for receiving bolts 50 therethrough to secure the rebound board 30 to the mounting rail 44. In this configuration, the upper ends of the support rails 47 are secured directly to the rebound board 30 by bolts 50 passed through the holes 39 in the end walls 36 and the complementary holes 48 in the support rails 47. It will be appreciated that, in this orientation also, the rebound board 30 is reversible so as to present either its concave surface 33 forwardly, as in FIG. 8, or to present its convex surface 32 forwardly, as in FIG. 9. All bolts 50 are secured by wing nuts 51 or other suitable nuts.

Figure 10:
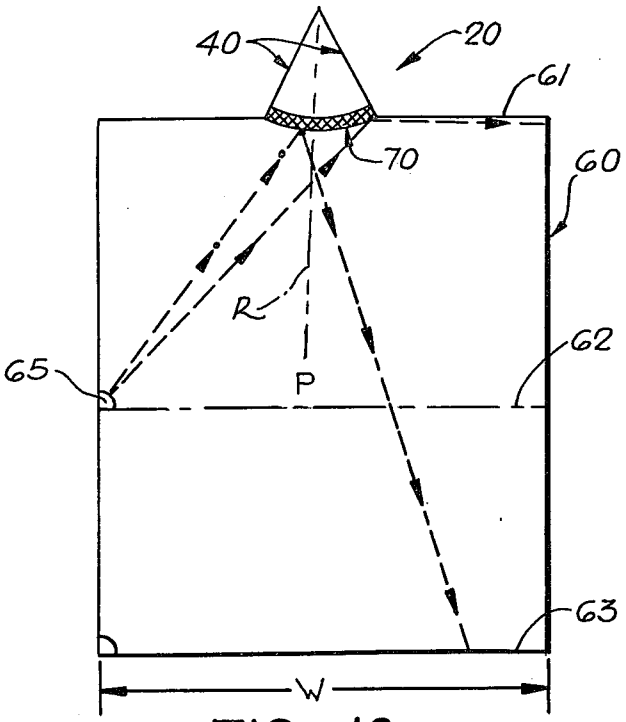
FIG. 10 is a diagrammatic plan view of a playing area in which a rebound apparatus of the present invention could be used, and illustrating an alternative version 70 of the rebound board.

In use the rebound apparatus 20 provides a wide range of rebound angles, as indicated in FIG. 10, which illustrates a playing area, generally designated by the numeral 60. For example, the playing area 60 may have a base line 61 at which the rebound apparatus 20 may be mounted, and a serving or throwing line 62 and an end line 63. For purposes of illustration, there is shown in FIG. 10 an alternative version 70 of rebound board for rebound apparatus 20, in which the side flanges 34 thereof would not be coplanar. Thus, the support frames 40 would not be parallel to each other, but would rather be inclined rearwardly in a wedge-shaped configuration. But regardless of which version of the rebound apparatus is used, it can be seen that because of the curvature of the rebound board 30, a ball can be rebounded into virtually any portion of the playing area 60 and a thrower can rebound the ball into a wide range of areas by simply aiming the ball at different portions of the rebound board 30 or 70. A player D can play alone and rebound the ball to himself by rebounding the ball from a point on the board 30 which lies along a radius of curvature R of the board, passing through the point where he is standing. It will be appreciated that a similar range of rebound angles would be possible if the concave surface of the rebound board 30 or 70 were presented to the player.

When the rebound apparatus 20 is not in use, the frames 40 can readily be folded and all of the parts can be disassembled for ease of storage and portability.

The rebound boards 30 and 70 and the frames 40 are preferably formed of plastic, but it will be appreciated that they could be formed of any suitable material, as long as the boards 30 and 70 have sufficient impact resistance. Also, while bolts and wing nuts have been utilized for fastening the parts of the rebound apparatus 20 together, it will be appreciated that any other suitable fastening arrangement could be used. Also, while the panel 31 is part-circularly cylindrical in shape, it will be appreciated that other cylindrical shapes could be used as well as other types of curved surfaces.

From the foregoing, it can be seen that there has been provided an improved rebound apparatus which utilizes a curved rebound board having convex and concave surfaces, the board being reversibly mountable to present either surface to the player and being selectively mountable in different orientations to afford a wide degree of flexibility and playing conditions.

What is claimed is:

1. A reversible ball rebound apparatus comprising a part-cylindrical rebound member having a continuous, uninterrupted and imperforate concave rebound surface on one side thereof and a continuous, uninterrupted and imperforate, convex rebound surface on the opposite side thereof, means for supporting said rebound member, and means for reversibly securing said rebound member to said supporting means for selectively supporting same on said supporting means with either said convex rebound surface or said concave rebound surface disposed forwardly without obstruction of the forward rebound surface by said supporting means.

2. The rebound apparatus of claim 1, wherein said rebound member is substantially rectangular in outline.

3. The rebound apparatus of claim 1, wherein said rebound member includes attachment portions connectable to said support means for reversibly supporting said rebound member.

4. The rebound apparatus of claim 1, wherein said rebound member forms a portion of a circular cylinder.

5. The rebound apparatus of claim 4, wherein said rebound member includes attachment portions adjustably attachable to said support means for selectively mounting said rebound member with the cylindrical axis disposed in either a vertical plane or a horizontal plane.

6. The rebound apparatus of claim 1, wherein said rebound member is non-rotatably mounted on said support means.

7. A ball rebound apparatus comprising a pair of support frames each having a mounting portion, and a part-circular cylindrical rebound member having a convex rebound surface and a concave rebound surface, said rebound member including a first pair of attachment flanges respectively disposed thereon at the lateral extremities thereof and projecting laterally therefrom and a second pair of attachment members respectively disposed thereon on the axial extremities thereof, and further including fastening means for securing said attachment flanges respectively to the mounting portions of said support frames for supporting said rebound member therebetween in a first orientation with the axis thereof disposed in a vertical plane, said second pair of attachment members being respectively connectable to the mounting portions of said frames for supporting said rebound member therebetween in a second orientation with the axis thereof disposed in a horizontal plane.

8. The rebound apparatus of claim 7, wherein said attachment flanges are substantially coplanar.

9. A ball rebound apparatus comprising a pair of support frames, each of said support frames comprising a triangular arrangement of three rails including a horizontal base rail and a mounting rail and a support rail, and a part-circular cylindrical rebound member having a convex rebound surface and a concave rebound surface, said rebound member including a first pair of attachment members respectively disposed thereon at the lateral extremities thereof and a second pair of attachment members respectively disposed thereon and the axial extremities thereof, said first pair of attachment members being respectively connectable to said mounting rails for supporting said rebound member therebetween in a first orientation with the axis thereof disposed in a vertical plane, said second pair of attachment members being respectively connectable to said mounting rails for supporting said rebound member therebetween in a second orientation with the axis thereof disposed in a horizontal plane, said support rail being adjustably connectable to said base rail for varying the inclination of said mounting rail and said rebound member.

10. A ball rebound apparatus comprising a pair of support frames, each of said support frames comprising a triangular arrangement of three rails including a horizontal base rail and a mounting rail and a support rail, each of said mounting rails having a first plurality of apertures extending transversely therethrough and a second plurality of apertures extending laterally therethrough normal to said first apertures, and a part-circular cylindrical rebound member having a convex rebound surface and a concave rebound surface, said rebound member including a first pair of attachment members respectively disposed thereon at the lateral extremities thereof and a second pair of attachment members respectively disposed thereon at the axial extremities thereof, and a plurality of fasteners respectively receivable through said first apertures for connection to said first pair of attachment members for mounting said rebound member in a first orientation with the axis thereof disposed in a vertical plane, said fasteners being respectively receivable through said second apertures for connection to said second pair of attachment members for mounting said rebound member in a second orientation with the axis thereof disposed in a horizontal plane.

11. A ball rebound apparatus comprising a pair of support frames, each of said support frames comprising a triangular arrangement of three rails including a horizontal base rail and a mounting rail and a support rail, and a part-circular cylindrical rebound member having a convex rebound surface and a concave rebound surface, said rebound member including a first pair of attachment members respectively disposed thereon at the lateral extremities thereof and a second pair of attachment members respectively disposed thereon at the axial extremities thereof, said first pair of attachment members being respectively attachable to said mounting rails for supporting said rebound member therebetween in a first orientation with the axis thereof disposed in a vertical plane, said second pair of attachment members being respectively connectable to said mounting rails for supporting said rebound member therebetween in a second orientation with the axis thereof disposed in a horizontal plane, said support rails being respectively connectable to said mounting rails for supporting said rebound member in its first orientation, said support rails being respectively connectable to said second attachment members for supporting said rebound member in its second orientation.

12. A reversible ball rebound apparatus comprising a rebound member having a continuous, uninterrupted and imperforate, concave rebound surface on one side thereof and a continuous, uninterrupted and imperforate, convex rebound surface on the opposite side thereof, said rebound member having first and second attachment means thereon, and support means cooperable with said first attachment means for supporting said rebound member on said support means with said convex rebound surface thereof disposed forwardly without obstruction of said convex rebound surface by said support means, said support means being cooperable with said second attachment means for supporting said rebound member on said support means with said concave rebound surface thereof disposed forwardly without obstruction of said concave rebound surface by said support means.

* * * * *